US007210463B2

(12) United States Patent
Haberer

(10) Patent No.: US 7,210,463 B2
(45) Date of Patent: May 1, 2007

(54) PUMP, ESPECIALLY FOR A FUEL INJECTION DEVICE FOR AN INTERNAL COMBUSTION ENGINE

(75) Inventor: Helmut Haberer, Gerlingen-Gehenbuehl (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/493,951

(22) PCT Filed: Feb. 11, 2003

(86) PCT No.: PCT/DE03/00383

§ 371 (c)(1),
(2), (4) Date: Sep. 24, 2004

(87) PCT Pub. No.: WO2004/022975

PCT Pub. Date: Mar. 18, 2004

(65) Prior Publication Data

US 2005/0031478 A1 Feb. 10, 2005

(30) Foreign Application Priority Data

Aug. 29, 2002 (DE) ..... 102 39 728

(51) Int. Cl.
*F02M 37/04* (2006.01)

(52) U.S. Cl. ..... 123/495; 417/273; 123/510

(58) Field of Classification Search ..... 123/495, 123/446, 456, 447, 510; 417/470, 570, 571, 417/273

See application file for complete search history.

(56) References Cited

U.S. PATENT DOCUMENTS

| | | | | |
|---|---|---|---|---|
| 4,968,220 | A * | 11/1990 | Filippi et al. | 417/273 |
| 5,979,297 | A * | 11/1999 | Ricco | 92/129 |
| 6,457,957 | B1 * | 10/2002 | Bauer et al. | 417/562 |
| 6,558,142 | B2 * | 5/2003 | De Matthaeis | 417/562 |
| 6,698,399 | B1 * | 3/2004 | Grabert | 123/456 |
| 2004/0022654 | A1 * | 2/2004 | Ishida | 417/440 |
| 2004/0035396 | A1 | 2/2004 | Braun et al. | |

FOREIGN PATENT DOCUMENTS

| | | |
|---|---|---|
| DE | 101 17 600 C1 | 8/2002 |
| EP | 1 013 921 A2 | 6/2000 |

* cited by examiner

*Primary Examiner*—Carl S. Miller
(74) *Attorney, Agent, or Firm*—Ronald E. Greigg

(57) ABSTRACT

A pump having least one pump element with a pump piston guided in a sealed fashion in a cylinder bore (26) of a housing part delimiting a pump working chamber in the cylinder bore, and driven into a stroke motion. The working chamber is connected to an inlet conduit through by an inlet valve opening into the pump working chamber and to an outlet conduit through an outlet valve opening out from the working chamber. The inlet valve has a valve element acted on in a closing direction by a valve spring. The inlet conduit includes a first blind bore which adjoins the pump working chamber and has a smaller diameter than the cylinder bore a valve seat is formed at the transition from the cylinder bore to the first blind bore, and a second blind bore, as another part of the inlet conduit, feeds into the first blind bore.

21 Claims, 2 Drawing Sheets

PUMP, ESPECIALLY FOR A FUEL INJECTION DEVICE FOR AN INTERNAL COMBUSTION ENGINE

CROSS-REFERENCE TO RELATED APPLICATIONS

This application is a 35 USC 371 application of PCT/DE 03/00383 filed on Feb. 11, 2003.

BACKGROUND OF THE INVENTION

1. Field of the Invention

The invention is directed to an improved pump for a fuel injection apparatus for an internal combustion engine.

2. Description of the Prior Art

A pump of the kind with which this invention is concerned, known from DE 198 48 035 A1, has at least one pump element with a pump piston that is guided in a sealed fashion in a cylinder bore of a housing part and delimits a pump working chamber in the cylinder bore with its end surface. The pump piston is driven into a stroke motion. The pump working chamber is connected to an inlet conduit via a connection controlled by an inlet valve opening into the pump working chamber and is connected to an outlet conduit via a connection controlled by an outlet valve opening out from the pump working chamber. The inlet valve has a valve element that cooperates with a valve seat and a valve spring acts on this valve element in the direction of the valve seat. The part of the inlet conduit feeding into the pump working chamber is comprised of a separate component that also contains the valve seat; this component is inserted into a bore of the housing part. The bore of the housing part is closed with a screw plug. The production and assembly of the known pump are complex and costly due to the large number of individual parts.

SUMMARY OF THE INVENTION

The pump according to the invention has the advantage over the prior art that it is simple and inexpensive to produce and assemble since the number of its individual parts has been reduced.

BRIEF DESCRIPTION OF THE DRAWINGS

An exemplary embodiment of the invention is described herein below, with reference to the drawings, in which.

DESCRIPTION OF THE PREFERRED EMBODIMENT

Figure 1:
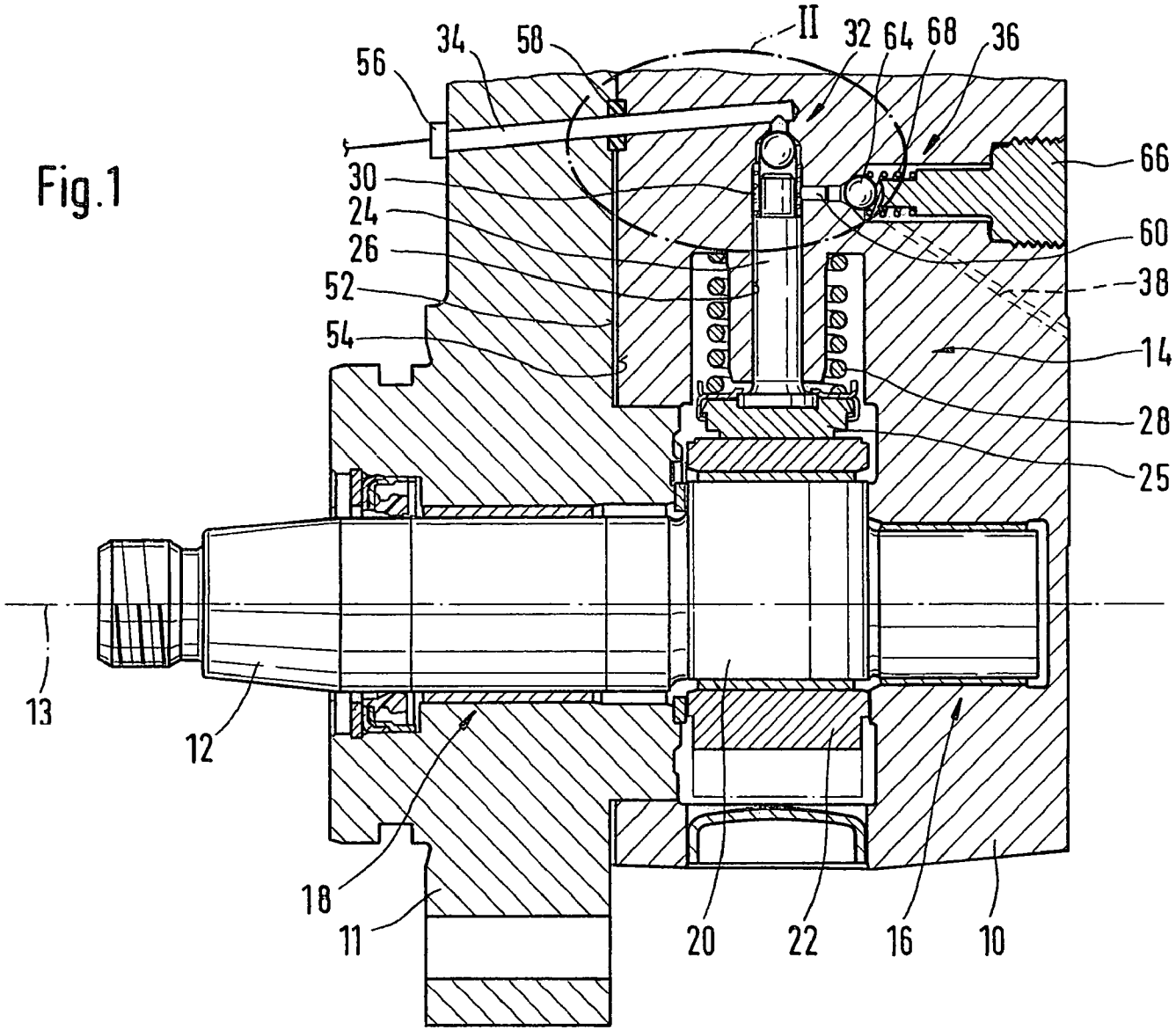
FIG. 1 shows a longitudinal section through a pump embodying the invention.
Figure 2:
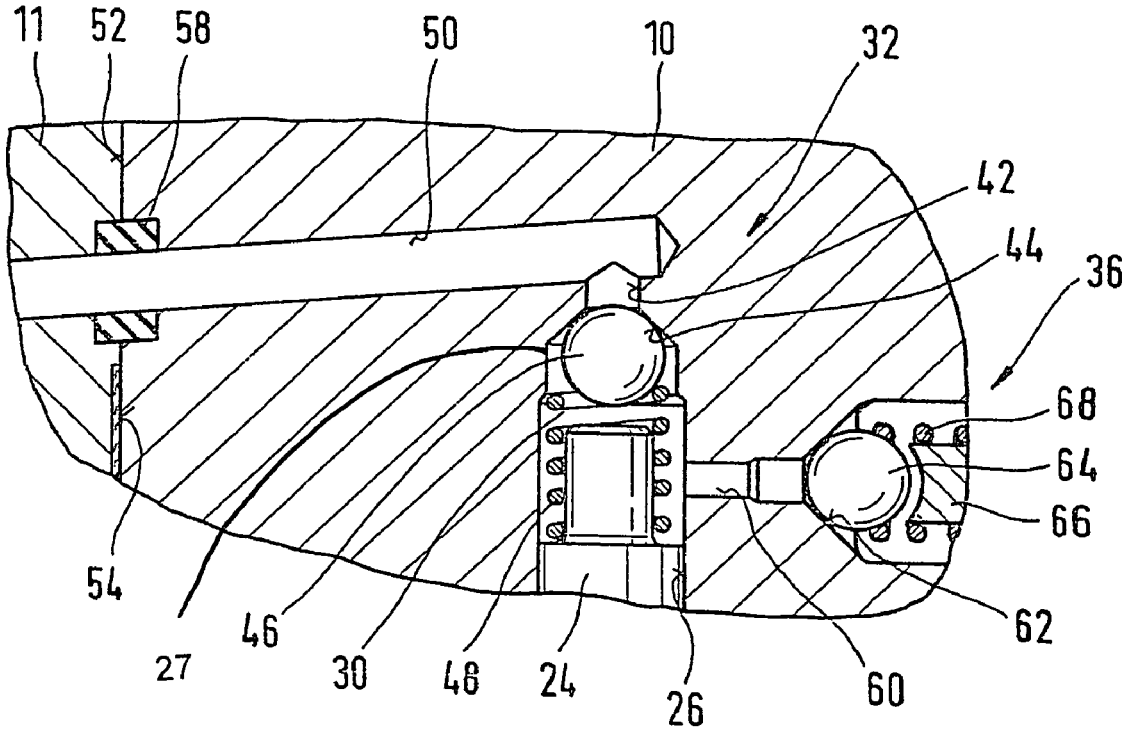
FIG. 2 shows an enlarged detail of the pump, which is labeled II in FIG. 1.

FIGS. 1 and 2 show a pump that is particularly provided for a fuel injection apparatus for an internal combustion engine, for example of a motor vehicle. The pump delivers fuel at a high pressure of up to 2000 bar, for example to an accumulator. The pump has a housing that has, for example, a housing part 10 and a flange part 11 connected to it. The housing has a drive shaft 12 disposed in it, which drives one or more pump elements 14 disposed in the housing. Preferably, a number of pump elements 14 are disposed distributed around the circumference of the drive shaft 12. A bearing 16 in the housing part 10 and a bearing 18 in the flange part 11 support the drive shaft 12 so that it can rotate around an axis 13; it is driven by the engine in a manner that is not shown. The drive shaft 12 has a cam section 20 that supports a stroke ring 22. The pump element 14 has a pump piston 24 that is guided so that it can slide in a sealed fashion in a cylinder bore 26 of the housing part 10 extending at least approximately radially in relation to the drive shaft 12. The pump piston 24 is supported with its piston base 25 against the stroke ring 22; the piston base 25 is kept in contact with the stroke ring 22 by a spring 28, which is supported at one end against the housing part 10 and at the other end, against the piston base 25.

The end surface of the pump piston 24 delimits a pump working chamber 30 in the cylinder bore 26, which bore 26 has a reduced diameter portion 27 at its end which reduces the idle volume of the bore 26. An inlet valve 32 that opens into the pump working chamber 30 can connect the pump working chamber 30 to a fuel inlet conduit 34 in which low pressure prevails. In addition, an outlet valve 36 that opens toward the accumulator can connect the pump working chamber 30 to the accumulator via a fuel outlet conduit 38 extending in the housing part 10. When the drive shaft 12 rotates, it drives the pump piston 24 in a stroke motion by means of the cam section 20 and the stroke ring 22. When the pump piston 24 moves radially inward, it executes an intake stroke during which the inlet valve 32 is opened so that fuel flows into the pump working chamber 30 via the fuel inlet conduit 34 while the outlet valve 36 is closed. When the pump piston 24 moves radially outward, it executes a delivery stroke during which the inlet valve 32 is closed and the fuel compressed by the pump piston 24 flows at high pressure through the open outlet valve 36, the fuel outlet conduit 36, and into the accumulator.

In the housing part 12, a first blind bore 42 that constitutes a part of the fuel inlet conduit 34 adjoins the pump working chamber 30 disposed in the end region of the cylinder bore 26 oriented radially away from the drive shaft 12. The first blind bore 42 has a smaller diameter than the cylinder bore 26 and preferably extends at least approximately coaxial to the cylinder bore 26. The first blind bore 42 ends inside the housing part 10. The transition from the cylinder bore 26 to the first blind bore 42 is embodied, for example, as at least approximately conical and constitutes a valve seat 44 for the inlet valve 32. The inlet valve 32 has a valve element 46, which is embodied, for example, as a ball, and cooperates with the valve seat 44 in order to control the connection of the pump working chamber 30 to the fuel inlet conduit 34. A prestressed valve spring 48, for example in the form of a helical compression spring, acts on the valve element 46 in the direction of the valve seat 44. A support element in the form of a spring plate can be disposed between the valve spring 48 and the valve element 46. As can be seen in FIG. 2, the reduced diameter portion 27 of the bore 26 can be just slightly larger than valve element 46 so as to reduce the idle volume of bore 26. The valve spring 48 can be supported in stationary fashion either against the housing part 10 or, as shown in the figure, against the end surface of the pump piston 24.

A second blind bore 50, which is let into the housing part 10 and also ends in the housing part 10, feeds into the first blind bore 42 as another part of the fuel inlet conduit 34. The second blind bore 50 extends inclined in relation to the first blind bore 42, preferably at least approximately perpendicular to the first blind bore 42 and at least approximately parallel to the rotation axis 13 of the drive shaft 12. The second blind bore 50 is let into the housing part 10 from a side surface 52 oriented toward the flange part 11. The fuel inlet conduit 34 continues in the flange part 11, starting from a side surface 54 of the flange part 11; the flange part 11 can be provided with a connection 56 for an inlet line via which fuel is supplied from a fuel tank, for example by means of a fuel-supply pump. A sealing element 58 can be clamped in place at the transition of the fuel conduit 34 between the flange part 11 and the housing part 10. The sides surfaces 52 and 54 of the housing part 10 and the flange part 11 facing each other extend, for example, at least approximately perpendicular to the rotation axis 13 of the drive shaft 12 and can be embodied as flat. The housing part 10 and the flange part 11 are attached to each other in a manner that is not shown, for example by means of a number of screws.

The blind bores 42 and 50 that make up the fuel conduit 34 in the housing part 10 can be simply let into the housing part 10 respectively from the cylinder bore 26 and from the side surface 52. The housing part 10 does not have any openings on its outside for the fuel conduit 34. The only additional components required for the inlet valve 32 are the valve element 46, the valve spring 48, and the support element possibly provided between them. It is possible for a number of pump elements 14 to be provided with a single shared housing part 10 that contains a corresponding number of cylinder bores 26 and blind bores 42 and 50. Alternatively, it is also possible for each pump element 14 to be provided with a separate housing part 10 that contains only one cylinder bore and one pair of blind bores 42, 50. The housing parts 10 of the pump elements 14 are then attached to one another in a suitable fashion.

As part of the fuel outlet conduit 38, a bore 60 that extends at least approximately perpendicular to the longitudinal axis of the cylinder bore 26 feeds into the pump working chamber 30 in the cylinder bore 26. The bore 60 is embodied with a multiply stepped diameter, its end section with a small diameter feeding into the pump working chamber 30. The end section is adjoined at its end oriented away from the pump working chamber 30 by a middle section of the bore 60; the transition between the end section of the and the middle section can be embodied, for example, as approximately conical and constitutes a valve seat 62 for the outlet valve 36. A valve element 64 of the outlet valve 36, for example in the form of a ball, cooperates with the valve seat 62 in order to control the connection of the pump working chamber 30 to the fuel outlet conduit 38. A screw plug 66 is screwed into an outer section of the bore 60 that has a diameter larger than that of the middle section and is provided with an internal thread. A prestressed valve spring 68, for example in the form of a helical compression spring, is clamped between the screw plug 66 and the valve element 64 and acts on the valve element 64 in the direction of the valve seat 62.

The foregoing relates to preferred exemplary embodiments of the invention, it being understood that other variants and embodiments thereof are possible within the spirit and scope of the invention, the latter being defined by the appended claims.

The invention claimed is:

1. A pump for a fuel injection apparatus for an internal combustion engine, the pump comprising at least one pump element (14) having a pump piston (24) guided in a sealed fashion in a cylinder bore (26) of a housing part (10) which delimits a pump working chamber (30) in the cylinder bore (26), the pump piston (24) being driven into a stroke motion, the pump working chamber (30) being connected to an inlet conduit (34) via a connection controlled by an inlet valve (32) opening into the pump working chamber (30) and connected to an outlet conduit (38) via a connection controlled by an outlet valve (36) opening out from the pump working chamber (30), the inlet valve (32) having a valve element (46) that cooperates with a valve seat (44) and being acted on in a closing direction toward the valve seat (44) by a valve spring (48), the inlet conduit (34) in the housing part (10) having a part in the form of a first blind bore (42), which directly adjoins the pump working chamber (30) in the cylinder bore (26) with no intervening structure between them, the first blind bore having a smaller diameter than the cylinder bore (26), the valve seat (44) being formed at the transition from the cylinder bore (26) to the first blind bore (42), and a second blind bore (50), as another part of the inlet conduit (34), feeding into the first blind bore (42).

2. The pump according to claim 1, wherein the first blind bore (42) extends at least approximately coaxial to the cylinder bore (26).

3. The pump according to claim 1, wherein the second blind bore (50) extends inclined in relation to the first blind bore (42) in the housing part (10).

4. The pump according to claim 2, wherein the second blind bore (50) extends inclined in relation to the first blind bore (42) in the housing part (10).

5. The pump according to claim 3, wherein the second blind bore (50) extends at least approximately perpendicular to the first blind bore (42).

6. The pump according to claim 4, wherein the second blind bore (50) extends at least approximately perpendicular to the first blind bore (42).

7. The pump according to claim 1, wherein the second blind bore (50) starts from a side wall (52) of the housing part (10) that adjoins another housing part (11).

8. The pump according to claim 5, wherein the second blind bore (50) starts from a side wall (52) of the housing part (10) that adjoins another housing part (11).

9. The pump according to claim 6, wherein the second blind bore (50) starts from a side wall (52) of the housing part (10) that adjoins another housing part (11).

10. The pump according to claim 1, wherein the housing part (10) contains a drive shaft (12) supported so that it can rotate in order to drive the at least one pump element (14), wherein the cylinder bore (26) and the first blind bore (42) extend at least approximately radial to the rotation axis (13) of the drive shaft (12), and wherein the second blind bore (50) extends at least approximately parallel to the rotation axis (13) of the drive shaft (12).

11. The pump according to claim 2, wherein the housing part (10) contains a drive shaft (12) supported so that it can rotate in order to drive the at least one pump element (14), wherein the cylinder bore (26) and the first blind bore (42) extend at least approximately radial to the rotation axis (13) of the drive shaft (12), and wherein the second blind bore (50) extends at least approximately parallel to the rotation axis (13) of the drive shaft (12).

12. The pump according to claim 3, wherein the housing part (10) contains a drive shaft (12) supported so that it can rotate in order to drive the at least one pump element (14), wherein the cylinder bore (26) and the first blind bore (42) extend at least approximately radial to the rotation axis (13) of the drive shaft (12), and wherein the second blind bore (50) extends at least approximately parallel to the rotation axis (13) of the drive shaft (12).

13. The pump according to claim 5, wherein the housing part (10) contains a drive shaft (12) supported so that it can rotate in order to drive the at least one pump element (14), wherein the cylinder bore (26) and the first blind bore (42) extend at least approximately radial to the rotation axis (13) of the drive shaft (12), and wherein the second blind bore (50) extends at least approximately parallel to the rotation axis (13) of the drive shaft (12).

14. The pump according to claim 7, wherein the housing part (10) contains a drive shaft (12) supported so that it can rotate in order to drive the at least one pump element (14), wherein the cylinder bore (26) and the first blind bore (42) extend at least approximately radial to the rotation axis (13) of the drive shaft (12), and wherein the second blind bore (50) extends at least approximately parallel to the rotation axis (13) of the drive shaft (12).

15. The pump according to claim 2, further comprising, for each pump element (14), a separate housing part (10) containing the cylinder bore (26), the first blind bore (42), the valve seat (44), and the second blind bore (50) for the pump element (14).

16. The pump according to claim 3, further comprising, for each pump element (14), a separate housing part (10) containing the cylinder bore (26), the first blind bore (42), the valve seat (44), and the second blind bore (50) for the pump element (14).

17. The pump according to claim 5, further comprising, for each pump element (14), a separate housing part (10) containing the cylinder bore (26), the first blind bore (42), the valve seat (44), and the second blind bore (50) for the pump element (14).

18. The pump according to claim 7, further comprising, for each pump element (14), a separate housing part (10) containing the cylinder bore (26), the first blind bore (42), the valve seat (44), and the second blind bore (50) for the pump element (14).

19. The pump according to claim 10, further comprising, for each pump element (14), a separate housing part (10) containing the cylinder bore (26), the first blind bore (42), the valve seat (44), and the second blind bore (50) for the pump element (14).

20. A pump for a fuel injection apparatus for an internal combustion engine, the pump comprising at least one pump element (14) having a pump piston (24) guided in a sealed fashion in a cylinder bore (26) of a housing part (10) which delimits a pump working chamber (30) in the cylinder bore (26), the pump piston (24) being driven into a stroke motion, the pump working chamber (30) being connected to an inlet conduit (34) via a connection controlled by an inlet valve (32) opening into the pump working chamber (30) and connected to an outlet conduit (38) via a connection controlled by an outlet valve (36) opening out from the pump working chamber (30), the inlet valve (32) having a valve element (46) that cooperates with a valve seat (44) and being acted on in a closing direction toward the valve seat (44) by a valve spring (48), the inlet conduit (34) in the housing part (10) having a part in the form of a first blind bore (42), which directly adjoins the pump working chamber (30) in the cylinder bore (26) with no intervening structure between them, the first blind bore having a smaller diameter than the cylinder bore (26), a second blind bore (50), as another part of the inlet conduit (34), feeding into the first blind bore (42), the valve seat (44) being formed at the transition from the cylinder bore (26) to the first blind bore (42), and further comprising, for each pump element (14), a separate housing part (10) containing the cylinder bore (26), the first blind bore (42), the valve seat (44), and the second blind bore (50) for the pump element (14), and the valve spring is braced on the pump piston.

21. The pump according to claim 1, wherein the cylinder bore (26) includes a reduced diameter portion (27) at its end nearest the first blind bore (42).

* * * * *